US006523547B1

(12) United States Patent
Crocilla

(10) Patent No.: US 6,523,547 B1
(45) Date of Patent: Feb. 25, 2003

(54) HAIRDRESSING COMB

(75) Inventor: Gaetano Crocilla, Armadale (AU)

(73) Assignee: Agigi Design Pty. Ltd., Windsor (AU)

( * ) Notice: Subject to any disclaimer, the term of this patent is extended or adjusted under 35 U.S.C. 154(b) by 0 days.

(21) Appl. No.: 09/806,444

(22) PCT Filed: Oct. 1, 1999

(86) PCT No.: PCT/AU99/00842

§ 371 (c)(1),
(2), (4) Date: Mar. 30, 2001

(87) PCT Pub. No.: WO00/19856

PCT Pub. Date: Apr. 13, 2000

(30) Foreign Application Priority Data

Oct. 1, 1998 (AU) ..... PP6305
Apr. 9, 1999 (AU) ..... PP9683

(51) Int. Cl.[7] ..... A45D 24/04
(52) U.S. Cl. ..... 132/139; 132/901
(58) Field of Search ..... 132/139, 150, 132/160, 161, 901, 136; D28/29, 30, 31, 34

(56) References Cited

U.S. PATENT DOCUMENTS 80,833 A * 8/1868 Picot ..... 132/136
2,216,355 A * 10/1940 Pollock ..... 132/160
2,436,548 A * 2/1948 Booth ..... 132/139
3,552,403 A * 1/1971 Sestito ..... 132/139
3,575,183 A * 4/1971 Tanner ..... 132/160
4,108,186 A 8/1978 Esposto
4,325,393 A * 4/1982 Thomas ..... 132/160
4,561,456 A * 12/1985 Gueret ..... 132/160
4,732,170 A * 3/1988 Thomas ..... 132/160
4,815,484 A 3/1989 Stevenson
5,018,542 A 5/1991 Lee
5,626,153 A * 5/1997 Petrarca ..... 132/139
5,819,758 A * 10/1998 Sohler ..... 132/160

FOREIGN PATENT DOCUMENTS

| | | |
|---|---|---|
| EP | 0372971 | 12/1989 |
| GB | 2238239 | 5/1991 |
| WO | WO95/23536 | 9/1995 |

* cited by examiner

*Primary Examiner*—Todd E. Manahan
(74) *Attorney, Agent, or Firm*—Volpe & Koenig, P.C.

(57) ABSTRACT

A hairdressing comb for use in tipping treatments. Each tooth comprises a root portion extending away from the comb's main body and a further tooth portion extending away from the root portion, the further portion being spaced from and generally parallel to the comb's main body. The array of teeth may extend from substantially the whole length of the comb's main body, with the body having a channel shape with side flanges so it may be attached to the back of a hairdresser's traditional tail comb.

20 Claims, 4 Drawing Sheets

HAIRDRESSING COMB

BACKGROUND TO THE INVENTION

This invention is directed to combs used in hairdressing and in particular to combs used for tipping.

A common procedure in modern hairdressing is the selective colouring of some hair strands. Done as large bundles of strands this gives a distinct streaked effect in the hair, or done in bundles of only small numbers of strands it can give a gentle highlighting effect. The colouring may be achieved by application of dyes or bleaching agent. This procedure shall be referred to in this specification by the general term of tipping.

In a tipping procedure the hairdresser traditionally selects a generally flat array of hair strands, the array often being only a single hair thick, and, while supporting them and gently tensioning them with one hand, uses a comb in the other hand to comb them carefully until they are aligned parallel to each other in a flat array. Traditionally the comb used has a spiked tail, the point of which is then used in a weaving manner to thread through the flat array of hair strands in order to separate it into alternating bundles of hair strands passing either over or under the comb tail. The bundles are separated using a sheet material such as metal foil and the colouring agent applied to those bundles on only one side of the foil which is then folded or rolled. The technique is well known to those skilled in the art and need not be described in further detail here.

The usual aim when separating the hair with the comb is to produce bundles which are equally sized and evenly spaced and a great deal of skill and practice is required to achieve this to a high degree. The procedure is time consuming.

It is an objective of this invention to provide a means whereby the separation of the hair strands into the desired bundles may be achieved consistently in a uniform manner, can be achieved more quickly and can be satisfactorily performed by a person having a lower level of hairdressing skills than those required for the traditional procedure.

SUMMARY OF THE INVENTION

Accordingly, in one aspect the present invention provides a hairdressing comb comprising a main body portion with an array of teeth spaced from each other extending outwardly therefrom, each tooth comprising a root portion extending away from said main body portion and a further portion extending away from said root portion said further portion of the tooth being spaced from and generally parallel to said main body portion and being shaped so as to impede hair coming into contact with the further portion from sliding along the further portion into the spacing between the teeth.

The comb may have a handle portion free of teeth for holding the comb by hand while in use. The comb may have a generally planar structure with a central body portion having conventional straight comb teeth extending in an array in a first direction perpendicular to the body portion and in a direction opposite that of the other array of teeth.

Alternatively the teeth may extend from substantially the whole length of the comb's main body portion, with the body portion adapted to be attached to the back of a hairdresser's traditional tail comb. Such a body portion may be channel shaped in cross section with said channel sized to resiliently clip onto the frame of the traditional tail comb.

Preferably a third portion of each tooth extends from said further portion generally parallel to and spaced from said root portion.

Each tooth may be bifurcated with a first branch extending away from the main body portion and the second branch comprises said further portion extending generally parallel to the main body portion. The first branch may extend away from the bifurcation at about right angles to the main body portion. The second branch may be bifurcated with:

(a) a third branch extending from the bifurcation in a direction away from the main body portion at about right angles to the main body portion, and (b) a fourth branch extending from the bifurcation in a direction towards the main body portion at about right angles to the main body portion.

Preferably each said further portion of a tooth extends in a direction parallel to the main body portion for about half the distance between adjacent teeth.

The first branch may extend firstly in a direction opposite to that of said second branch and then secondly in a direction away from the main body portion at about right angles to the main body portion. In this case, for each tooth the sum of the distances said first and second branches extend parallel to the main body portion is about half the distance between adjacent teeth.

BRIEF DESCRIPTION OF THE DRAWINGS

Some embodiments of the invention will now be described with reference to the attached drawings where.

DETAILED DESCRIPTION OF PRIOR ART

Figure 1:
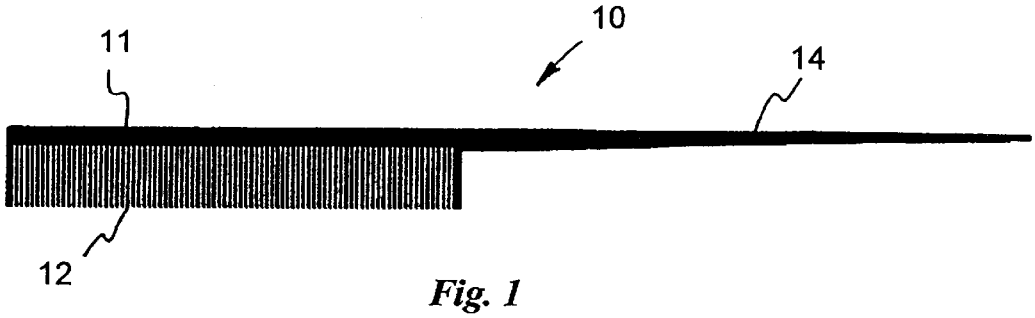
Fig. 1 (Prior Art)
FIG. 1 shows a traditional tail comb as used by hairdressers.

Referring to FIG. 1, the traditional tail comb 10 has a body portion 11 from which extends a pointed tail 14 and a planar array of straight teeth 12 at right angles. The comb 10 is usually moulded as a single piece from plastics material although the tail 14 may be a metal rod embedded into a body 11 moulded from plastic.

Figure 2:
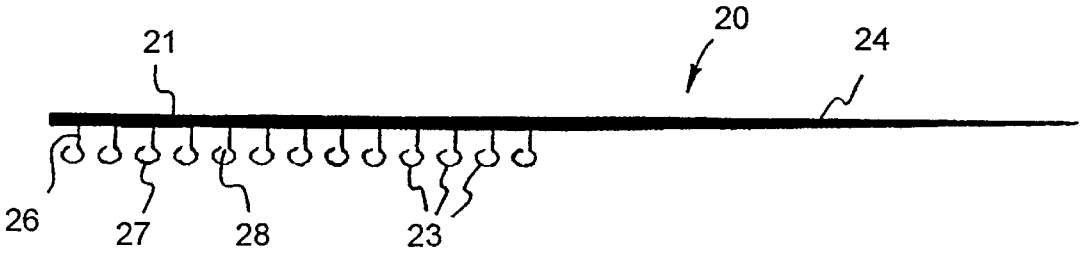
Fig. 2 (Prior Art)
FIGS. 2 and 3 show prior art combs, adapted for tipping.

Referring to FIG. 2, the comb 20 has a body portion 21, tail 24 and shaped teeth 23. Each tooth has a root portion 26, extending at right angles from the body 21, and a further portion being a tip portion 27 which is formed as a loop in the plane of the body and tooth root. Each loop has a gap 28 between the end of the tooth and the tooth root portion 26. When such a comb is used in the above described hair tipping procedure, it is pressed against the generally flat array of hair strands and a selection of hair strands may be made by manipulating them in through the gap 28 before withdrawing the comb back from the array bringing the captive strands with it.

Figure 3:
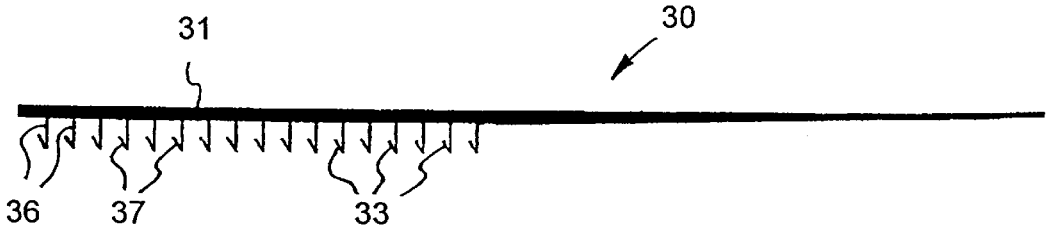
Fig. 3 (Prior Art)

The comb 30 shown in FIG. 3 is used similarly to comb 20. Its teeth have a root portion 36, extending from the body portion 31, and a tip portion 37 which is bent back through approximately 135° relative to the root portion 36.

In practice however the combs of FIGS. 2 and 3 can be difficult to use. The fact that all the hair is directed onto the main body portion of the comb causes difficulty. When positioning the hairs into the hooks, only a slight movement of the comb in the line of its body portion results in a large variation in the number of hairs hooked. Also a conventional comb must be used before them to produce the flat array of hair, and the hair held flat while combs are changed.

While the combs shown in FIGS. 2 and 3 are commonly known they are not generally used because of the difficulty hairdressers have achieving satisfactory results with them.

The present invention is intended to alleviate some or all of the above difficulties depending on the particular embodiment.

DETAILED DESCRIPTION OF EMBODIMENTS OF THE INVENTION

Figure 4:
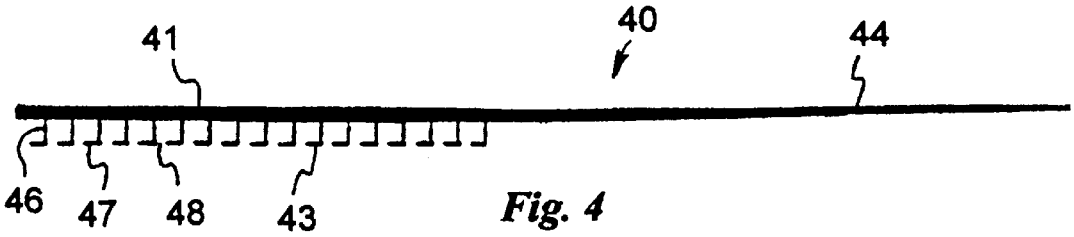
FIG. 4 shows a first embodiment of a tipping comb according to the present invention.

Referring to FIG. 4, the comb 40 is somewhat similar to those shown in FIGS. 2 and 3 except that the tip portion 47 of each tooth 43 is bent at right angles to the root portion 46 of the tooth. The tip 47 extends approximately half way to the adjacent tooth leaving a gap 48 between the teeth. When such a comb is pressed onto the flat array of hair, half the strands are displaced, being carried forward by the tip portion of the teeth and only the hair strands aligned with the gap 48 pass through to rest against the body portion 41. A gentle lengthwise movement of the comb away from the tail before withdrawal of the comb allows the non-displaced strands to be hooked and then withdrawn. This configuration of comb is easier to use than the prior art shown in FIGS. 2 and 3 and also gives a more accurately even separation of hair into the required bundles.

Combs having wider or narrower spacings between the teeth may be used depending on the final visual effect required from the colouring process. Also, combs may have a gap 48 with a different length to that of the tooth tip 47.

The invention envisages that the tooth tips 47 may point towards or away from the tail but they must all be in the same direction. Any hairdresser may have a personal preference for one orientation or the other but both are effective.

Figure 5:
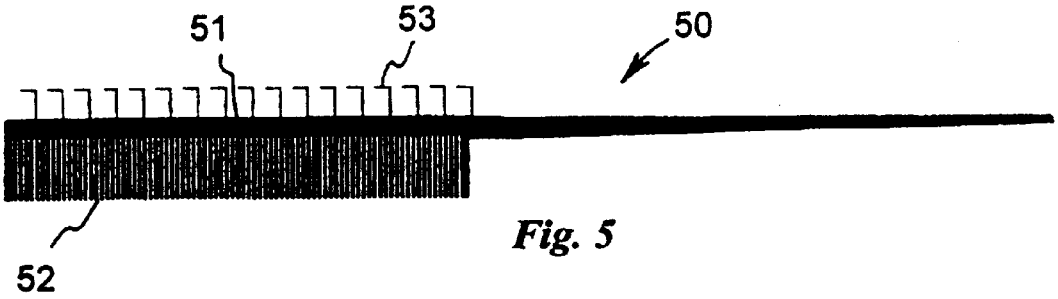
FIG. 5 shows a second embodiment of a tipping comb according to the present invention.

Referring to FIG. 5, the comb 50 shown is a combination of the features of the traditional tail comb of FIG. 1 and the comb of FIG. 4. It is moulded from plastics material as a single unit. From the body portion 51 conventional straight teeth 52 extend in a planar array in one direction and bent teeth 53 extend in an array in the same plane but in the opposite direction. This double sided feature allows the hairdresser to use a single comb throughout the operations of combing and selection of strands.

Figure 6:
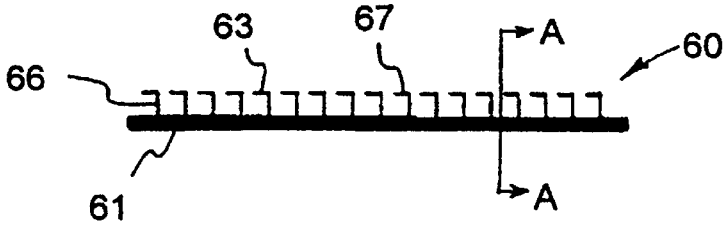
FIG. 6 shows a third embodiment of a tipping comb according to the present invention.
Figure 7:
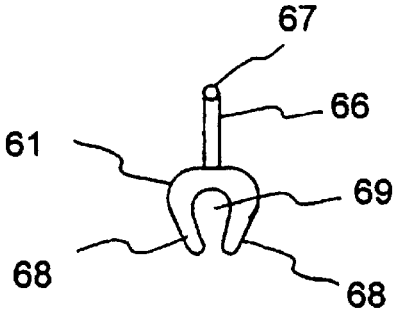
FIG. 7 is a cross section view through A—A indicated on FIG. 6.

Referring to FIGS. 6 and 7, the configuration of teeth described in relation to FIG. 4 is carried on a body portion 61 which has a U-shape cross-section. There is no tail portion. This comb is intended to be attached by way of opposed resilient flanges 68 clipping onto the back of a traditional tail comb (for example that shown in FIG. 1) in order to form in combination a comb of the general configuration shown in FIG. 5. The flanges 68 clamp onto the body portion 11 of the comb 10 which slides into the channel 69 between the flanges. The implement it thus produces is slightly heavier to use than the unitary moulded equivalent described in relation to FIG. 5, but it nevertheless allows a convenient means to gain the advantages of the configuration. It is anticipated that a set of three or four such clip-on combs having different tooth spacings may be purchased by a hairdresser and these clipped on to a conventional tail comb as required.

Figure 8:
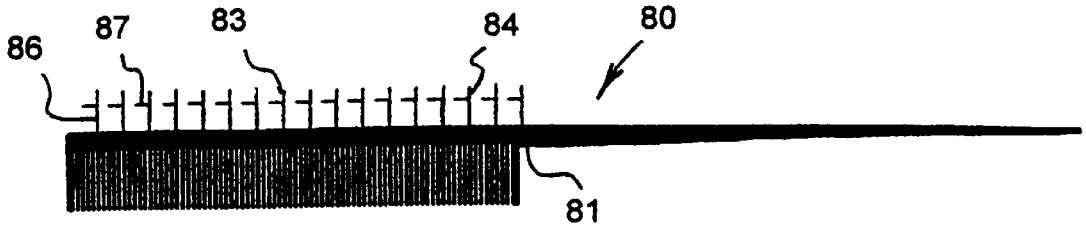
FIG. 8 shows a fourth embodiment of the invention, which is particularly preferred.

The comb shown in FIG. 8 is identical to that of FIG. 5 except for the shape of the teeth 83 which, in addition to a root portion 86 at right angles to the body 81 of the comb and a tip portion 87 extending parallel to the body 81, also have a further tip portion 84 continuing in the line of the root portion 86. The teeth 83 are accordingly bifurucated, with one branch being tip potion 84 extending away from the bifurcation at right angles to the body 81, and the other branch being tip portion 87 extending generally parallel to the body 81. Another way of viewing teeth 83 is to consider the tip portion 84 and root portion 86 together as a straight tooth of the comb while tip portion 87 is a side branch.

Comb 80 is used in a similar fashion to that described above for comb 50 but it has the added advantage that the addition of the tip portion 84 means that when the comb is moved lengthwise away from the tail in order to move to behind tip portion 87 those hair strands that have passed through the gap 48, the strands that did not pass through the gap slide along the front face of tip portion 87 until they are restrained by tip portion 84. This prevents any possibility of strands originally caught by the tip portion 87 then slipping off to be caught up with those which originally passed through the gap.

Figure 9:
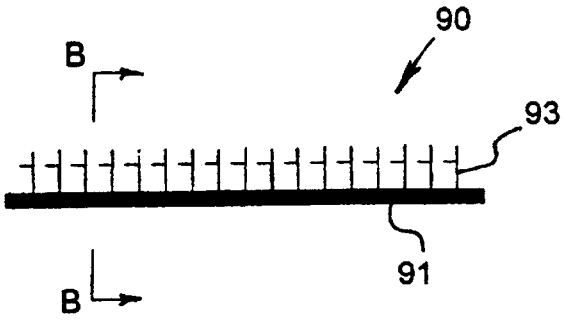
FIG. 9 shows a fifth embodiment of the invention, which is also particularly preferred.
Figure 10:
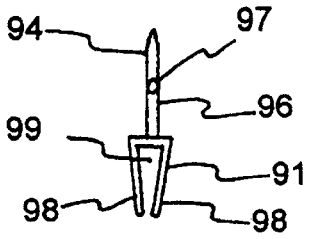
FIG. 10 is a cross section view through B—B indicated on FIG. 9.

The comb 90 shown in FIGS. 9 and 10 is similar to that of FIGS. 6 and 7 except that it carries a planar array of teeth 93 formed the same as teeth 83 in FIG. 8 and its body portion 91 has a U-shape with a lighter cross section than that of FIG. 6. The flanges 98 spring clamp onto the body portion of a conventional comb which slides into the channel 99 between the flanges. Branched teeth 93 extend from the body 91 with the root portion 96 continuing into a tip portion 94 at right angles to the body and a tip portion 97 extending parallel to the body.

Figure 11:
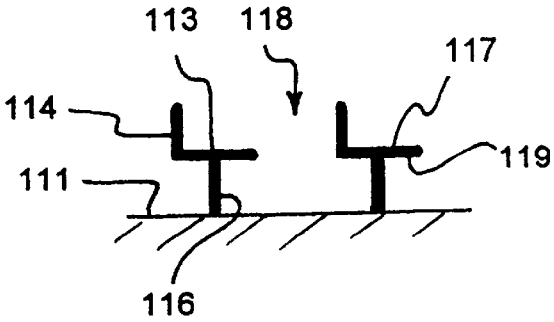
FIG. 11 shows an alternative form of teeth suitable for a comb comprising a sixth embodiment of the invention.

The form of the comb teeth 113 shown in FIG. 11 is less preferred than that of FIG. 9 but is described here to illustrate an alternative. The root potion 116 of each tooth 113 extend at right angles from the body portion 111 of the comb. It then branches into a tip portion 117 parallel to the body 111 and, via an elbow, to a tip portion 114 parallel to the tooth root 116. Alternatively it may be viewed that from the bifurcation of root portion 116 one branch (tip portion 117) extends parallel to the body 111 while the other branch (tip portion 114) extends firstly in a direction opposite to that of tip portion 117 and then secondly in a direction away from the body 111 at right angles to the body.

The portion 117 extends parallel to the main body portion about half the distance between adjacent teeth so that the gap 118 between the teeth is about the same as the length of tooth parallel to the body 111 so in use approximately half the hair is retained on the tooth while half passes through to rest against the body. However the underside 119 of the tip portion 117 that is available to draw the hair out of the array is much smaller than the corresponding tooth of FIG. 8 and this is a disadvantage.

Figure 12:
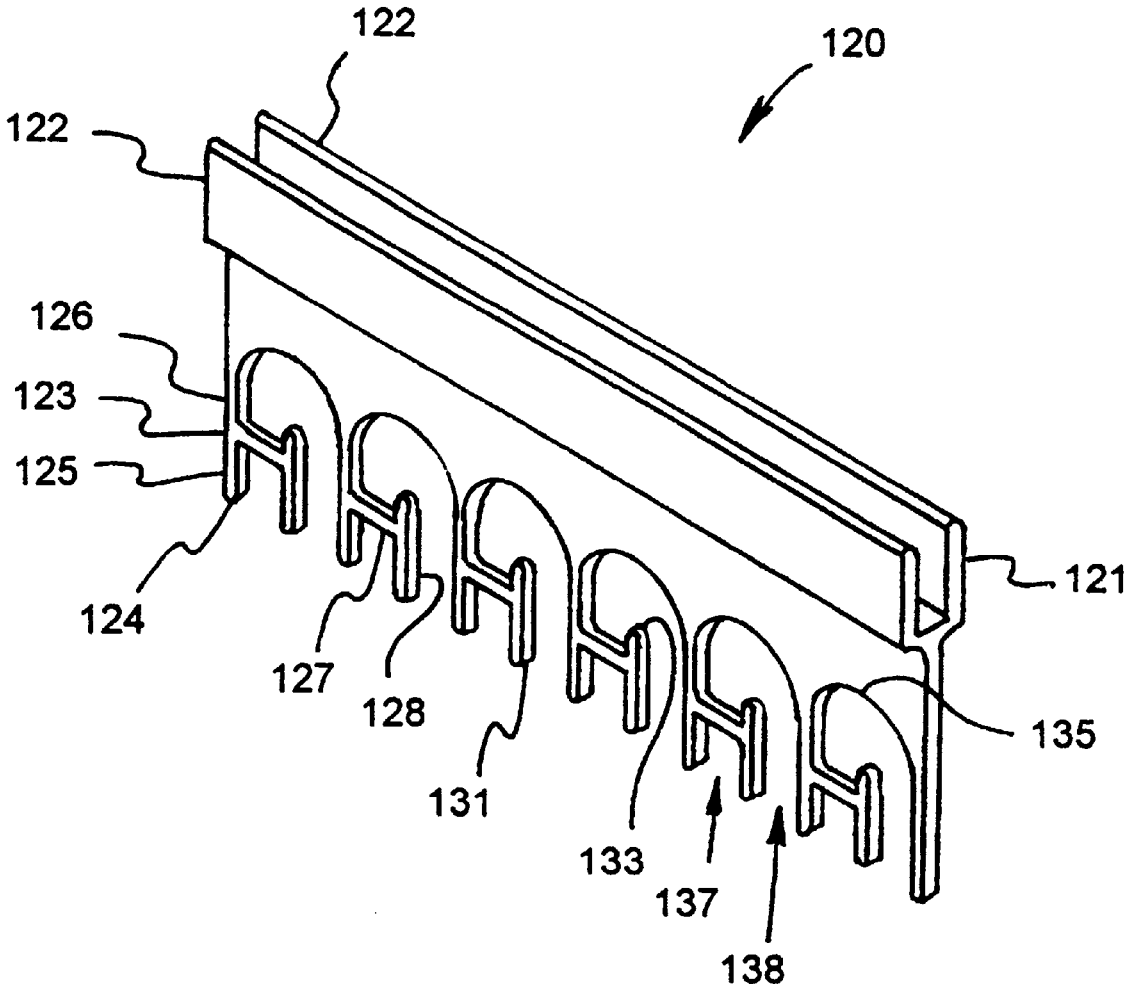
FIG. 12 is an isometric view of a segment of a seventh embodiment of the invention which is most particularly preferred.

Referring to FIG. 12, only a segment of the fill comb 120 is shown. The full comb would have more teeth repeated in order to produce its full length. As with comb 90 in FIG. 9, comb 120 does not have a handle portion free of teeth for holding the comb while in use and instead has a channel shaped body portion 121 with side flanges 122 adapted to spring clamp onto the back of a hairdresser's conventional tail comb. Each tooth 123 extends perpendicularly from the body portion 121 along a root portion 126 towards a first tip 124. About 40% to 80%, preferably two thirds, of the way to the tip 124 a rail portion 127 extends from the root portion 126 parallel to the body 121 for a distance 30% to 70% of the distance between adjacent root portions. At the end of the rail portion 127 it butts into an offset tooth portion 128 which is parallel to the root portion 126. The root portion continues past its junction with the rail portion to a first tip portion 125 which is a short segment of tooth extending from the rail portion to the first tip 124. The offset tooth portion 128 extends from the rail 127 away from the body 121 to a second tip 131 and towards the body to a retaining tip 133.

Alternatively the teeth 123 in the preferred embodiment illustrated in FIG. 12 may be described as being bifurcated a first time with a first branch (tip portion 125) extending away from the main body portion and a second branch (rail portion 127) extending generally parallel to the main body portion, and said second branch being bifurcated also such that a third branch (tooth portion 128) extends away from the body 121 at right angles to the body and a fourth branch (inwards directed tooth portion 129) extends towards the body 121 at right angles to the body.

Root portions 126 of adjacent teeth are linked by a curved web 135 to form an arch between adjacent teeth. This webbing provides increased stabilisation for the teeth and the comb body 121.

To use the comb shown in FIG. 12, it is first clipped to the back of a conventional tail comb having conventional teeth. The hairdresser uses the conventional teeth to comb and select a generally flat array of parallel hair strands in the conventional manner, while supporting them and gently tensioning them with one hand. The comb is then inverted and the teeth shown in FIG. 12 are pressed into the array of hair strands. Half the hair passes through the gaps 137 between the first tip portions 125 and their directly connected offset tip portions 128 and is pressed forward by the rail 127. The other half of the hair passes through the gaps 138 to rest against the arches 135. The comb is then moved longitudinally of the body (towards the right as shown in FIG. 12) and then withdrawn from the array of hair. The bundles of strands which passed into one of gaps 137 are able to return through that gap, the first tip portion 125 and the offset tip portion 128 having retained the hair on the rail 127. But the strands which passed through gap 138 have moved around to behind the rail 127 and are drawn back by the rail as the comb is withdrawn. The retaining tip 133 serves to prevent strands slipping from the rail and leaving back through the gap 138.

A tipping comb of this form makes it easy for even relatively inexperienced apprentices to correctly separate the required amount of hair, with the correct spacing, for tipping treatments.

The comb 120 is shown in FIG. 12 with the offset tooth portions 128 positioned centrally between the first tip portions 125. This causes the hair to be separated into equal sized bundles of hair strands so that half the hair would be selected for tipping and half left untipped. Alternatively the offset tooth portions 128 could be positioned closer to the first tip portion extending from the same rail or closer to the neighboring first tip portion so that more or less than half of the hair is selected for tipping treatment. Also, the lengths of the rails on any comb need not be the same and such variation would create a controlled variation in the size of bundles to be treated.

Throughout this specification, unless the context requires otherwise, the word "comprise", and variations such as "comprises" and "comprising", will be understood to imply the inclusion of a stated feature or group of features but not the exclusion of any other feature or group of features.

Finally, it is to be understood that various alterations, modifications and/or additions may be introduced into the constructions and arrangements of parts previously described without departing from the spirit or ambit of the invention.

What is claimed is:

1. A hairdressing comb comprising a main body portion with an array of teeth extending outwardly therefrom, each tooth comprising a root portion extending away from said main body portion and a further portion extending away from said root portion, said further portion of the tooth being spaced from and generally parallel to said main body portion, wherein each tooth is bifurcated with a first branch extending away from the main body portion and the second branch comprises said further portion extending generally parallel to the main body portion.

2. A comb according to claim 1 wherein a third portion of each tooth extends from said further portion generally parallel to and spaced from said root portion.

3. A comb according to claim 1 wherein said first branch extends away from the bifurcation at about right angles to the main body portion.

4. A comb according to claim 1 wherein said second branch is bifurcated with:

(a) a third branch extending from the bifurcation in a direction away from the main body portion at about right angles to the main body portion, and (b) a fourth branch extending from the bifurcation in a direction towards the main body portion at about right angles to the main body portion.

5. A comb according to claim 1 wherein said first branch extends firstly in a direction opposite to that of said second branch and then secondly in a direction away from the main body portion at about right angles to the main body portion.

6. A comb according to claim 5 wherein for each tooth the sum of the distances said first and second branches extend parallel to the main body portion is about half the distance between adjacent teeth.

7. A comb according to claim 1 wherein each said further portion of a tooth extends to the main body portion about half the distance between adjacent teeth.

8. A comb according to claim 2 wherein the teeth extend from the main body portion generally at right angles to the main body portion.

9. A comb according to claim 1 wherein said third portion of the tooth extends from the further portion of the tooth both towards and away from the main body portion.

10. A comb according to claim 1 wherein:

(a) each tooth on a main body portion of the comb extends perpendicularly from the main body portion along a root portion of the tooth to a first tip, (b) at a distance of 40% to 80% of the distance to said first tip a branch from the root portion forms a rail portion which extends from the root portion parallel to the body portion for a distance of 30% to 70% of the distance between adjacent said root portions, and (c) at the end of the rail portion it butts into an offset tooth portion which is parallel to the root portion and extends from the rail portion in one direction away from said body portion to a second tip and, in the other direction, towards but stopping short of the body portion.

11. A comb according to claim 10 wherein said first and second tips are generally equidistant from the body portion.

12. A comb according to claim 1 wherein the root portions of adjacent teeth are linked by a curved web to form an arch between adjacent teeth.

13. A comb according to claim 1 having a handle portion free of teeth for holding the comb by hand while in use.

14. A comb according to claim 13 and comprising:

(a) a generally planar structure, (b) said main body portion central the planar structure, (c) said array of teeth extending from the body portion in a first direction of the plane, and (d) conventional straight comb teeth extending perpendicular to the body portion in a second array in the direction opposite to said first direction.

15. A comb according to claim 1 wherein said array of teeth extend from substantially the whole length of the main body portion, with the body portion adapted to be attached to the back of a hairdresser's traditional tail comb.

16. A comb according to claim 15 wherein said main body portion has a channel-shaped cross section and said channel is sized to resiliently clip onto the body of said traditional tail comb.

17. A hairdressing comb comprising a main body portion with an array of teeth spaced from each other extending outwardly therefrom, each tooth comprising a root portion extending away from said main body portion and a further portion extending away from said root portion, said further portion of the tooth being spaced from and generally parallel to said main body portion and being shaped so as to impede hair coming into contact with the further portion from sliding along the further portion into the spacing between the teeth, each tooth being bifurcated with a first branch extending away from the main body portion and the second branch comprising said further portion extending generally parallel to the main body portion.

18. A comb according to claim 17 therein said second branch is bifurcated with:

(a) a third branch extending from the bifurcation in a direction away from the main body portion at about right angles to the main body portion, and (b) a fourth branch extending from the bifurcation in a direction towards the main body portion at about right angles to the main body portion.

19. A comb according to claim 17 wherein:

(a) each tooth on a main body portion of the comb extends perpendicularly from the main body portion along a root portion of the tooth to a first tip, (b) at a distance of 40% to 80% of the distance to said first tip a branch from the root portion forms a rail portion which extends from the root portion parallel to the body portion for a distance of 30% to 70% of the distance between adjacent said root portions, and (c) at the end of the rail portion it butts into an offset tooth portion which is parallel to the root portion and extends from the rail portion in one direction away from said body portion to a second tip and, in the other direction, towards but stopping short of the body portion.

20. A comb according to claim 17 and comprising:

(a) a generally planar structure, (b) said main body portion central the planar structure, (c) said array of teeth extending from the body portion in a first direction of the plane, and (d) conventional straight comb teeth extending perpendicular to the body portion in a second array in the direction opposite to said first direction.

* * * * *

UNITED STATES PATENT AND TRADEMARK OFFICE

CERTIFICATE OF CORRECTION

PATENT NO. : 6,523,547 B1
DATED : February 25, 2003
INVENTOR(S) : Gaetano Crocilla It is certified that error appears in the above-identified patent and that said Letters Patent is hereby corrected as shown below:

Column 6,
Line 51, delete “claim 2”, and insert therefor -- claim 1 --.
Line 54, delete “claim 1”, and insert therefor -- claim 2 --.

Column 8,
Line 4, delete “therein”, and insert therefor -- wherein --.

Signed and Sealed this

Second Day of September, 2003

JAMES E. ROGAN
*Director of the United States Patent and Trademark Office*